US011610571B2

(12) United States Patent
Mills

(10) Patent No.: US 11,610,571 B2
(45) Date of Patent: Mar. 21, 2023

(54) HUMBUCKER PICKUP FOR STRING INSTRUMENTS WITH INTERPOSED TONE-ALTERING SIGNAL PROCESSOR

(71) Applicant: Christopher B. Mills, Wayne, PA (US)

(72) Inventor: Christopher B. Mills, Wayne, PA (US)

( * ) Notice: Subject to any disclaimer, the term of this patent is extended or adjusted under 35 U.S.C. 154(b) by 256 days.

(21) Appl. No.: 17/000,848

(22) Filed: Aug. 24, 2020

(65) Prior Publication Data

US 2021/0125596 A1 Apr. 29, 2021

Related U.S. Application Data

(60) Provisional application No. 62/925,574, filed on Oct. 24, 2019.

(51) Int. Cl.
*G10H 3/18* (2006.01)
*G10H 3/26* (2006.01)

(52) U.S. Cl.
CPC ..... *G10H 3/181* (2013.01); *G10H 3/182* (2013.01); *G10H 3/26* (2013.01); *G10H 2220/515* (2013.01)

(58) Field of Classification Search
CPC ..... G10H 3/181; G10H 3/182; G10H 3/26; G10H 2220/515
USPC ..... 84/726
See application file for complete search history.

(56) References Cited

U.S. PATENT DOCUMENTS 3,249,677 A * 5/1966 Burns ..... G10H 3/182 984/369
3,668,295 A * 6/1972 Broussard ..... G10H 3/181 984/368
3,742,113 A * 6/1973 Cohen ..... G10H 3/26 84/738
4,581,974 A * 4/1986 Fender ..... G10H 3/182 84/735
4,711,149 A 12/1987 Starr
4,941,388 A * 7/1990 Hoover ..... G10H 3/18 984/375
5,070,759 A * 12/1991 Hoover ..... G10H 3/26 84/DIG. 10
5,189,241 A * 2/1993 Nakamura ..... G10H 3/181 84/728
5,292,999 A * 3/1994 Tumura ..... G10H 3/26 84/738
5,523,526 A * 6/1996 Shattil ..... H05K 9/00 84/728

(Continued)

FOREIGN PATENT DOCUMENTS

WO 2012174320 A2 12/2012

OTHER PUBLICATIONS

Yuetone_XC-600127-1212403, XICON, 42TL Series Transformers, 2 pages, downloaded Sep. 2, 2019.

*Primary Examiner* — Christina M Schreiber
(74) *Attorney, Agent, or Firm* — Saul Ewing LLP; Brian R. Landry; Brandon Newton

(57) ABSTRACT

A pickup for stringed instruments with an interposed tone-altering signals process is described herein. In one aspect, the pickup can include a first coil wound around a first plurality of pole pieces, where a first end of the first coil is coupled directly to an amplifier output; a second coil wound around a second plurality of pole pieces; and a tone-altering signal processor coupled to an end of the second coil and the amplifier output.

14 Claims, 5 Drawing Sheets

100

(56) References Cited

U.S. PATENT DOCUMENTS

| | | | | |
|---|---|---|---|---|
| 5,932,827 | A * | 8/1999 | Osborne | G10H 3/18 84/738 |
| 7,385,125 | B2 | 6/2008 | Motsenbocker | |
| 8,664,507 | B1 | 3/2014 | Lawing | |
| 8,946,537 | B2 | 2/2015 | Yaron | |
| 9,245,511 | B1 * | 1/2016 | Ando | G10H 3/182 |
| 9,646,594 | B1 * | 5/2017 | Micek | G10H 1/12 |
| 9,842,580 | B1 * | 12/2017 | Krasnov | G10H 3/182 |
| 10,217,450 | B2 * | 2/2019 | Baker | G10H 3/186 |
| 10,380,986 | B2 * | 8/2019 | Baker | G10H 3/188 |
| 11,380,295 | B2 * | 7/2022 | Hoover | G10H 3/182 |
| 2002/0069749 | A1 * | 6/2002 | Hoover | G10H 3/26 84/738 |
| 2011/0218022 | A1 * | 9/2011 | Chiu | G10D 3/06 463/7 |
| 2014/0245877 | A1 * | 9/2014 | Gelvin | G10H 3/181 84/727 |
| 2015/0199949 | A1 * | 7/2015 | Fishman | G10H 3/18 84/726 |
| 2016/0247497 | A1 * | 8/2016 | Palmieri, III | G01N 29/2412 |
| 2017/0162180 | A1 * | 6/2017 | Beers | G10H 3/182 |
| 2019/0057678 | A1 * | 2/2019 | Baker | G10H 3/182 |
| 2020/0365129 | A1 * | 11/2020 | Baker | G10H 3/22 |
| 2020/0410970 | A1 * | 12/2020 | Baker | G10H 3/182 |
| 2021/0125596 | A1 * | 4/2021 | Mills | G10H 3/182 |
| 2021/0151022 | A1 * | 5/2021 | Hoover | H03F 3/187 |
| 2021/0407486 | A1 * | 12/2021 | Baker | G10H 3/146 |

* cited by examiner 300-a 300-b

HUMBUCKER PICKUP FOR STRING INSTRUMENTS WITH INTERPOSED TONE-ALTERING SIGNAL PROCESSOR

CROSS-REFERENCE TO RELATED APPLICATION

This application claims priority under 35 U.S.C. § 119(e) of U.S. Provisional Patent Application Ser. No. 62/925,574, filed Oct. 24, 2019. The entire content of this application is hereby incorporated by reference herein.

FIELD OF INVENTION

The disclosure relates generally to pickups for musical instruments, and, more specifically, to a pickup for a musical instrument having an interposed, tone altering signal processor.

BACKGROUND OF THE INVENTION

Many string instruments have pickups that convert vibrations of a string instrument to an electrical signal where it may be amplified and reproduced through loudspeakers or provided to a recording device. Pickups are commonly available in two forms: magnetic pickups and piezoelectric pickups. Magnetic pickups are typically included within electric guitars, electric basses, electric banjos and similar devices and typically consist of one or more magnetic poles wrapped with a coil of several thousand turns of copper wire and are typically mounted on the body of an instrument. The one or more magnetic pole pieces create a magnetic field that is disturbed by the motion of the vibrating strings, changing the magnetic flux and inducing an electric current through the coil. The pickup is typically communicatively coupled with an amplifier and/or recording equipment.

SUMMARY

A pickup for stringed instruments with an interposed tone-altering signals process is described herein. In one aspect, the pickup can include a first coil wound around a first plurality of pole pieces, where a first end of the first coil is coupled directly to an amplifier output; a second coil wound around a second plurality of pole pieces; and a tone-altering signal processor coupled to an end of the second coil and the amplifier output.

This aspect can include a variety of embodiments. In one embodiment, the tone-altering signal processor can further include at least one inductor. In some cases, the tone-altering signal processor can further include at least one capacitor, at least one potentiometer, or a combination thereof. In some cases, the at least one capacitor and the at least one inductor can be coupled in series or parallel. In some cases, the at least one potentiometer can be coupled in series with the at least one inductor.

In another embodiment, the first coil and the second coil can be wound in a counterclockwise direction or a clockwise direction.

In another embodiment, the first coil can be wound in a clockwise direction and the second coil can be wound in a counterclockwise direction.

In another embodiment, the first coil and the second coil can be coupled in parallel.

In another embodiment, the first plurality of pole pieces and the second plurality of pole pieces can each include at least four pole pieces. In another embodiment, the first plurality of pole pieces and the second plurality of pole pieces can each include at least six pole pieces.

In another embodiment, each of the first plurality of pole pieces and the second plurality of pole pieces can be magnets.

In another embodiment, each of the first plurality of pole pieces and the second plurality of pole pieces can include ferromagnetic materials lying within a magnetic field.

In another embodiment, the pickup can further include an encasing, where the encasing encloses the first bobbin, the second bobbin, and the at least one inductor.

In another embodiment, a string instrument can include the pickup and a plurality of strings, where each string of the plurality of strings passes over a respective pole piece of the first plurality of pole pieces and the second plurality of pole pieces. In some cases, the string instrument can be one of an electric guitar, an electric bass guitar, and an electric banjo.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Without being bound by theory, Applicant asserts that conventional approaches to varying the tonal qualities of a pickup are limited as such approaches only rely upon varying a small number of parameters within the pickup. Applicant identified that by interposing a tone altering signal processor between coil windings of a pickup, the tonal qualities of the pickup can be further altered and enhanced. Pickups having an interposed, tone-altering signal processor between coil windings are described in greater detail within the following disclosure.

Figure 1:
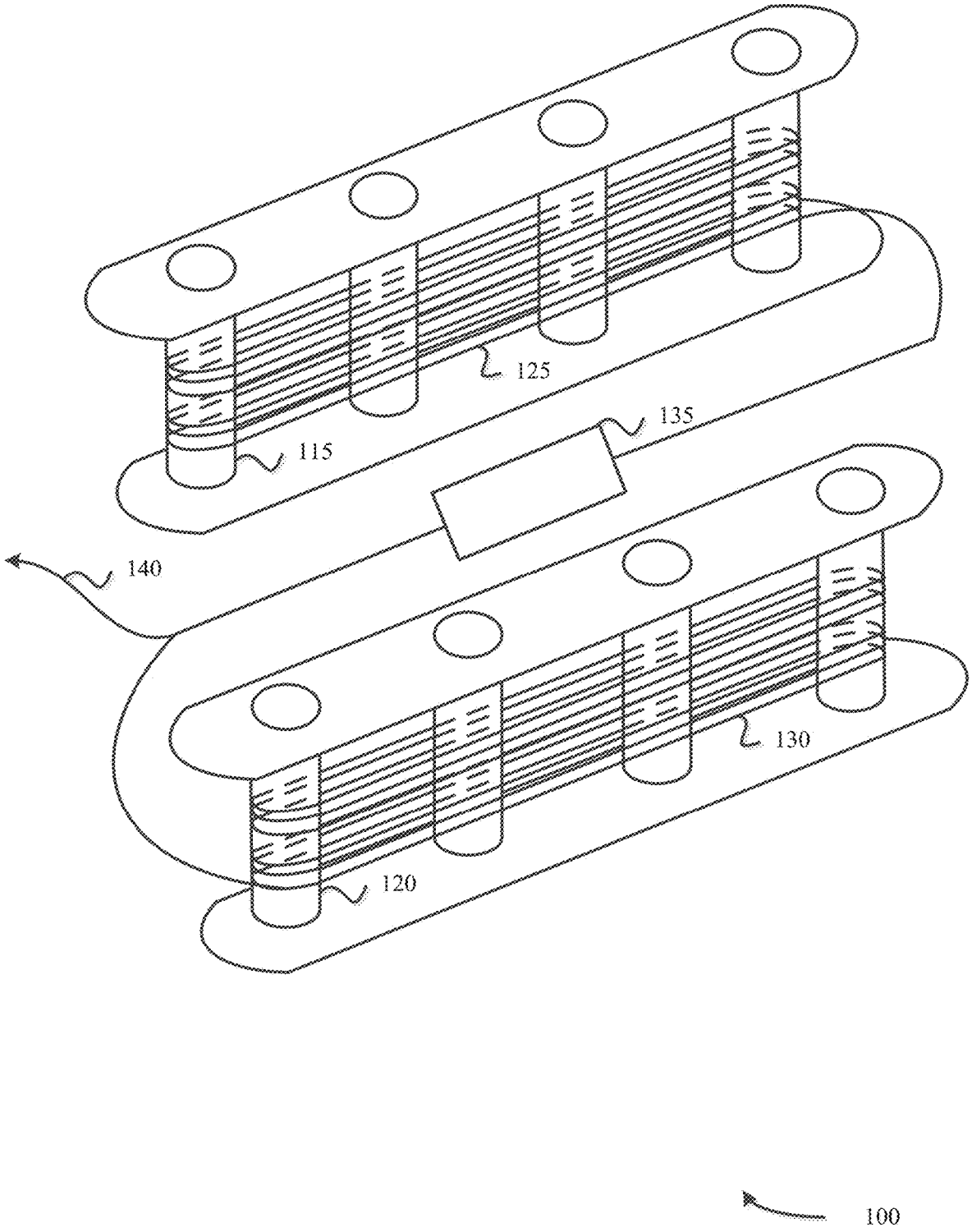
FIGS. 1 and 2 depict a pickup according to embodiments of the claimed invention.

Referring to FIG. 1, one embodiment of a pickup 100 for a string instrument is shown. The pickup 100 includes a first coil winding 125 and a second coil winding 130. Each coil winding can be wound around a set of pole pieces (e.g., first pole piece set 115 and second pole piece set 120). The number of pole pieces for each coil winding can vary. For example, as shown in FIG. 1, each coil winding can include four pole pieces each. However, the pole piece sets are not limited to four pole pieces each, and can include a multitude of pole pieces. The coils can be wrapped around the respective pole pieces. The number of coil windings and the direction of the coil windings can vary for the pickup 100 and/or each respective pole piece set. Further, in some cases, the coil can be wound around a subset of the pole pieces of a pole piece set, or can be wound with a various number of windings for subsets of pole pieces. These elements and others will be described below in greater detail.

In one or more embodiments, the pole pieces are (but need not be) aligned with the strings of a string instrument and serve as a magnetic conductor for a corresponding string. Various spring spacing conventions exists and spacing rulers are available, for example, from Stewart-McDonald of Athens, Ohio.

The coil windings 125 and 130 can be connected to one another. For example, the first coil winding 125 can include one end connected to an end of the second coil winding 130.

The connection between the coil windings can also include a tone altering signal processor 135. The signal processor 135 can include a variety of circuitry components that affect the tonal qualities of the first coil winding 125, the second coil winding 130, or both. For example, the signal processor 135 can include an inductor, a capacitor, a volume controller, or any combination thereof.

The signal processor 135 can alter the electrical signals originating from the coil windings of the pickup 100. For example, the coil windings 125 and 130 can generate electrical signals corresponding to energy transferred from vibrating strings of an instrument. The signal processor 135 can modify the electrical signals outputted from the pickup 100 based on the location at which the signal processor 135 is located. For example, FIG. 1 depicts the signal processor 135 connected to the output of the first coil winding 125. As such, the signal processor 135 can modify the electrical signal generated from the first coil winding 125, while leaving the electrical signal generated from the second coil winding 130 unaffected.

Because the electrical signal from the pickup 100 can be converted to an audio signal (e.g., via output 140), the tonal quality of the pickup 100 can be altered by the signal processor 135 as well. Further, the tonal quality modification can vary based on the position of the components of the signal processor 135. In some cases, as shown in FIG. 1, the signal processor 135 can be located between the first coil winding 125 and the second coil winding 130. In other cases, the signal processor 135 can be located within one of the coil windings. In yet other cases, different components of the signal processor 135 can be interspersed throughout the pickup 100.

Figure 2:
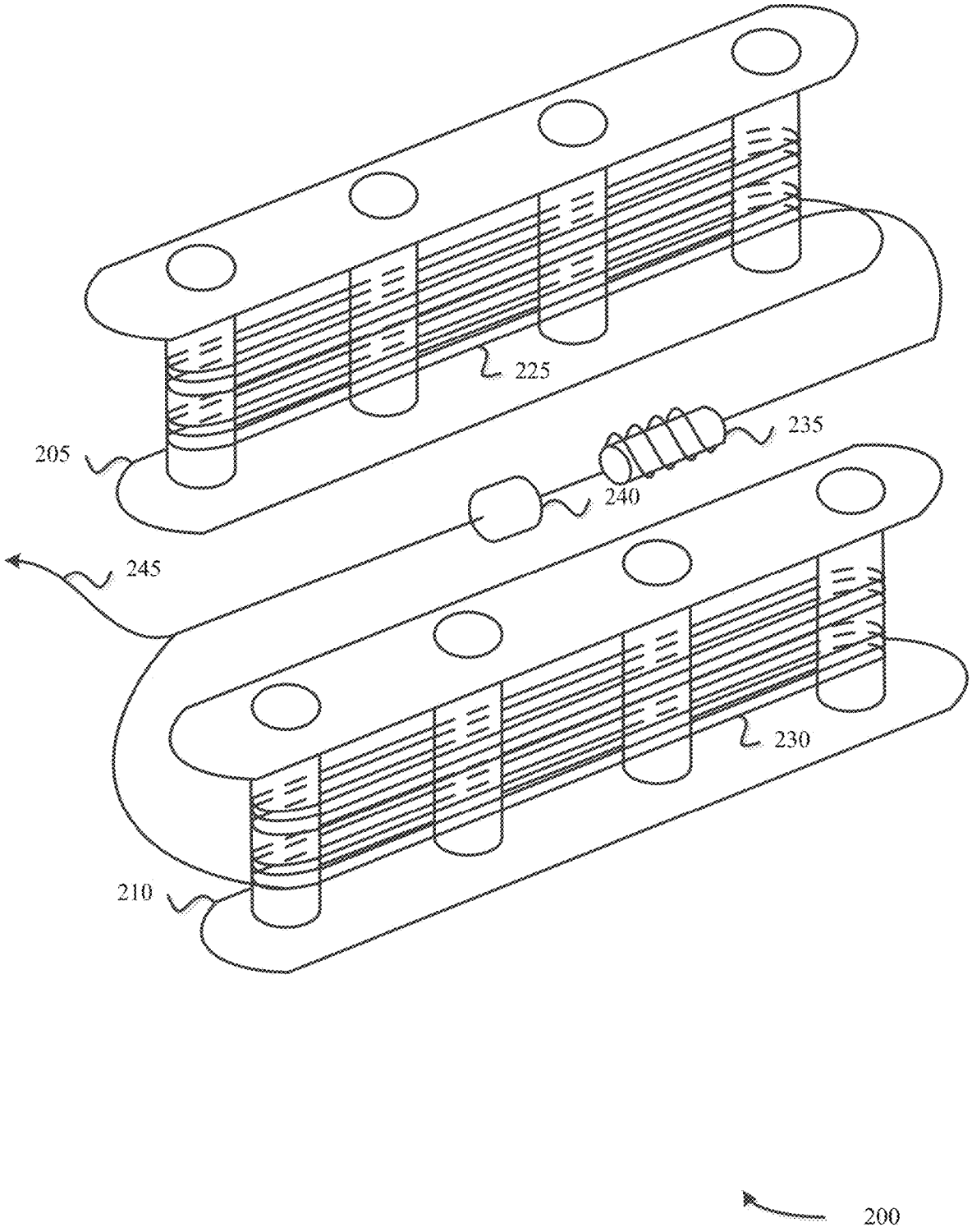

As stated above, the signal processor 135 can include a variety of electrical circuitry components. In some cases, the signal processor 135 can include an inductor, such as inductor 235 between first coil winding 225 and an output 245 to an external amplifier as shown in FIG. 2. For example, the inductor 235 can be an air-core inductor (e.g., a basket-weave coil inductor, a spider web coil inductor, a Litz inductor, an axial inductor, etc.), a ferromagnetic-core inductor (e.g., a ferrite-core inductor, a laminated-core inductor, a powdered-iron-core inductor, a toroidal-core inductor, etc.), a variable inductor, a choke, and the like.

Additionally, a capacitor 240 can be included in the pickup 200. The capacitor 240 can be any type of capacitor known in the art, for example, a ceramic capacitor, a film and paper capacitor, a polymer capacitor, a supercapacitor, an aluminum capacitor, a tantalum capacitor, a niobium-electrolytic capacitor, a silver-mica capacitor, a glass capacitor, a silicon capacitor, an air-gap capacitor, a vacuum capacitor, and the like. The capacitor 240 and the inductor 235 can act in some cases as a frequency filter for electrical signals generated from one or both of the coil windings 225 and 230.

Figure 3A:
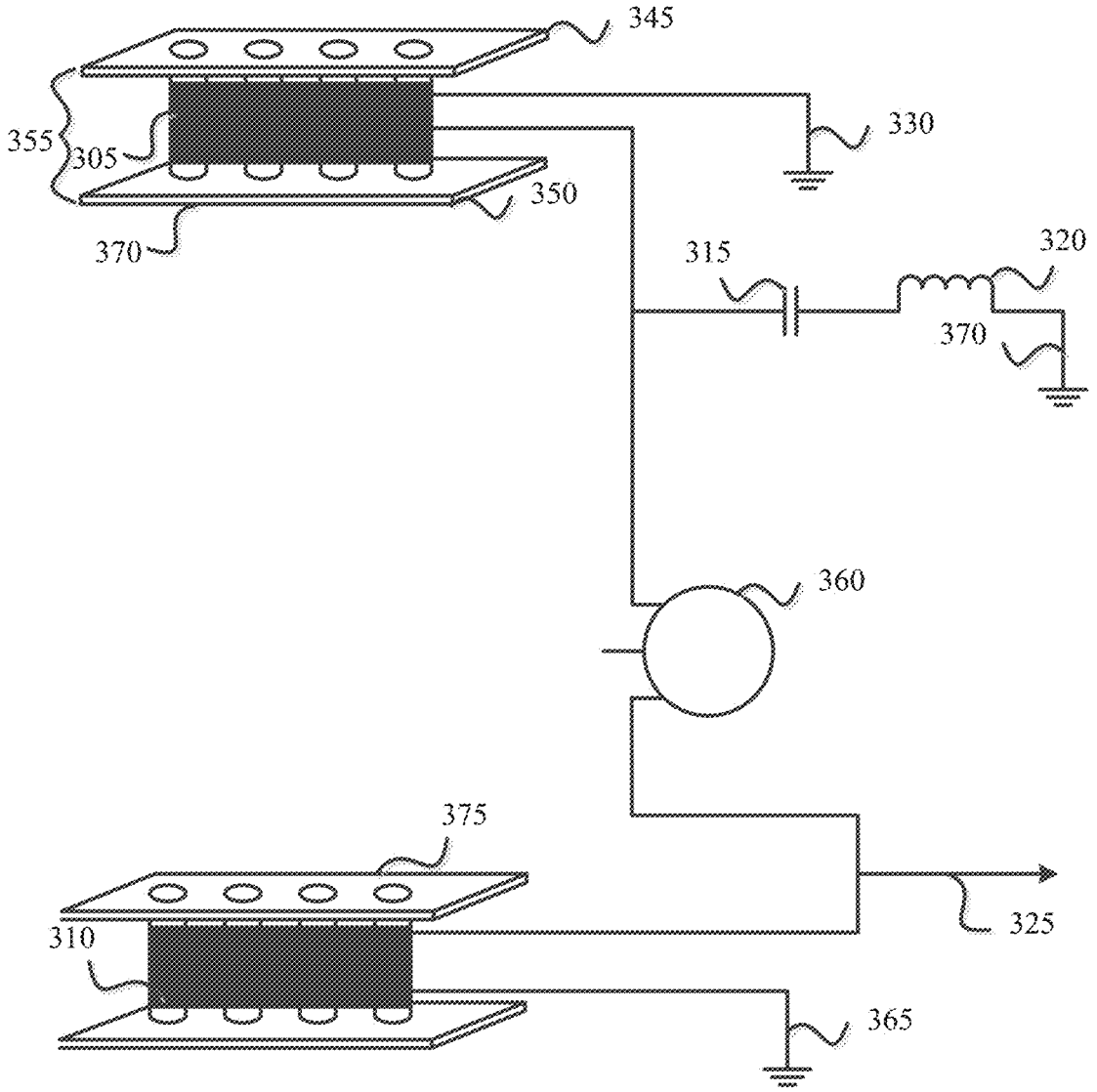
FIGS. 3A and 3B depict a circuit designs for a pickup according to an embodiment of the claimed invention.
Figure 3B:
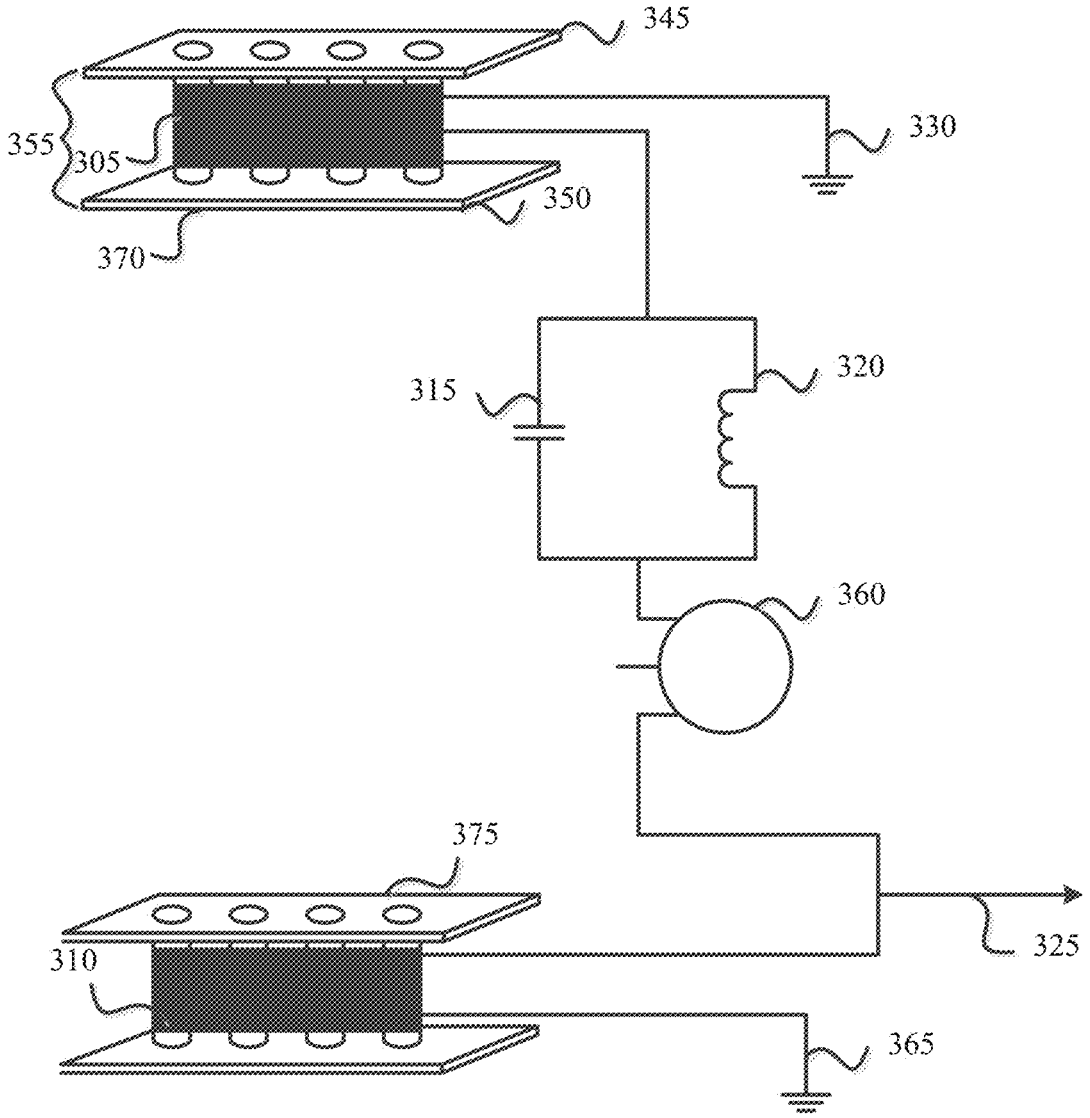

In some cases, a volume controller can also be included as a component of the signal processor. A volume controller 360 is depicted in FIGS. 3A and 3B. The volume controller 360 can be any type of volume controller known in the art, such as a volume potentiometer, a tone potentiometer, a no-load potentiometer, a blender potentiometer, and the like.

The components of the signal processor can be connected in series, in parallel, or a combination thereof. A configuration in which the capacitor and inductor are connected in series is depicted in FIG. 2. Alternatively, FIGS. 3A and 3B depict circuit diagrams 300-*a* and 300-*b*, respectively, illustrating two coil windings (e.g., 305 and 310), with an inductor 320 and capacitor 315 connected between the coil windings. Further, the volume controller 360 can be connected between the windings. In circuit design 300-*a*, the capacitor 315 and inductor 320 are connected separately from the volume controller 360, such that the capacitor 315 and inductor 320 are connected to ground 370. Alternatively, in circuit design 300-*b*, the capacitor 315 and inductor 320 are connected to the volume controller 360. The connections of the various components can be in either series (e.g., capacitor 315 and inductor 320 in FIG. 3B) or parallel (e.g., capacitor 315 and inductor 320 in FIG. 3A), and are not limited to the connection types shown in the circuit designs 300-*a* and 300-*b*.

In some cases, the coil windings can also be connected in parallel with one another. As shown, the coil windings each have an end connected to ground (e.g., ground 330 and 365), which provides a parallel connection between the coil windings (e.g., along with parallel output 325).

In some embodiments, the pole pieces of the pickup 100 are disposed along a non-linear path such that a first pole piece interacts with a corresponding string of a string instrument differently than a second pole piece interacts with a corresponding string of the string instrument. For example, the pole pieces may interact with corresponding strings at different distances from a common reference point. Alternatively, the pole pieces are disposed along a linear path.

The pickup 100 can include four pole pieces. However, in other embodiments, the pickup 100 may include less than or more than four pole pieces. For example, the pickup 100 may include 3, 5, 6, 12, or 24 pole pieces. Further, the pickup 100 may include a pole piece for each string of a corresponding instrument.

In various embodiments, the distances between adjacent pole pieces are based on the distances of corresponding strings of an instrument. The pole pieces can be configured to be centered under corresponding strings, defining the spacing or distance between pole pieces.

In one embodiment, the distance between a first adjacent pair of pole pieces differs from the distance between a second adjacent pair of pole pieces. In other embodiments, the distances between each adjacent pair of pole pieces is the same. Further, distances between each adjacent pair of pole pieces can differ. Further yet, at least one distance between adjacent pole pieces can differ from the others.

In various embodiments, each pole piece includes a magnetic material. In other embodiments, each pole piece includes a ferromagnetic material lying within a magnetic field, e.g., induced by a magnet otherwise coupled with the pole pieces. In one embodiment, each pole piece includes steel coupled with one or more magnets. For example, each pole piece may be a steel bolt or rod that is coupled with a magnet sitting below the pole pieces.

The orientation of the pole pieces determines the direction of the magnetic field within the pickup 100. For example, the pole pieces may be configured to create a north or south magnetic charge. The direction of the magnetic charge may also be referred to as the polarity of the pickup.

With continued reference to FIG. 1, the wire coil 125 and/or 130 is disposed around pole pieces 115. The wire coil 125 and/or 130 includes several thousand turns of wire, e.g., fine wire such as 42 or 43 AWG. The wire can be coated with an insulator such as enamel, polymer, polyurethane, and the like. The wire can have a copper conductor or use other ductile metals such as aluminum, cadmium, niobium (also known as "columbium"), copper, gold, iron, nickel, platinum, silver, tantalum, titanium, zinc, zirconium, and the like, and alloys thereof. In one embodiment, the wire coil 125 and/or 130 may be coated after winding (e.g., through dip coating in a material such as wax, lacquer, epoxy, and the like) to reduce feedback. Further, the wire coil 125 and/or 130 can have a profile corresponding to the path of pole pieces.

In some cases, a first end of the first wire coil may be coupled to a positive connection and a second end of the second wire coil may be coupled a negative connection of an amplifier and/or recording device such that electrical signals corresponding to disruptions in the magnetic field of the pickup may be communicated to the amplifier and/or recording device. In some cases, the first end of the first wire coil may be coupled to ground and the second end of the second wire coil can be coupled to a signal output of the amplifier and/or recording device. The wire coil may be referred to as having a direction of wind. The direction of wind corresponds to the path that electricity flows through the wire coil and is defined by which ends of the wire coil are coupled to positive and negative (or ground) connections. The coil can be connected to a phone connector (e.g., a ¼" phone jack, also known as a TS connector) for coupling to an amplifier.

In some cases, the coil windings can optionally include a bobbin, such as bobbins 205 and 210 of FIG. 2, or bobbins 370 and 375 of FIGS. 3A and 3B. Bobbin 370 can include a recess 355 and top and bottom support members (345 and 350). The recess 355 can be defined by the top and bottom support members (345 and 350). In one embodiment, the bobbin 370 further includes a plurality of pole posts and the recess 355 is further defined by the plurality of posts. Further, the first wire coil 305 can be disposed within the recess 355 of bobbin 370.

In various embodiments, one or more pole pieces may be housed within corresponding pole posts, such as pole pieces as described in FIG. 1. In one embodiment, coil windings 305 and/or 310 includes an equal number of pole posts as pole pieces of the pickup. In other embodiments, coil windings 305 and/or 310 includes less pole posts than pole pieces of the pickup. In such embodiments, the coil windings 305 and/or 310 may include one more holes within support members configured to receive a corresponding pole post.

In other embodiments, the top and bottom support members (345 and 350) include a plurality of holes configured to receive the pole posts. The pole posts are positioned within corresponding holes of the first and second support members (345 and 350) and couple the first and second support members with each other. In such embodiments, the coil windings 305 and/or 310 may or may not include pole posts (e.g., pole posts configured to receive pole pieces).

In one embodiment, the coil windings 305 and/or 310 may be one continuous piece of plastic formed using plastic molding techniques, 3D printing, or a similar process. In other embodiments, the support members and/or pole posts are separately formed and then coupled together to form the bobbin 370 and/or 375 (e.g., via adhesive, ultrasound welding, and the like).

As is illustrated in FIG. 1, the profile of the bobbins 370 and/or 375 can be rectangular in shape. However, in other embodiments, the profile of bobbin 370 and/or 375 may be substantially circular, or elliptical in shape. Without being bound by theory, Applicant believes that any bobbin 370 and/or 375 can have any profile that facilitates mounting within a string instrument. Further, in various embodiments, the profile of bobbin 370 and/or 375 may include one or more curved or angle portions.

In one embodiment, the wire coil 305 and/or 310 may be formed separately from the bobbin 370 and/or 375 and then placed over the posts of the bobbin 370 and/or 375. For example, a wire coil 305 and/or 310 may be formed around a mandrel and then placed over the posts of the bobbin.

The wire coil 305 and/or 310 may be formed such that it has a profile corresponding to that of the pole posts before it is placed around the pole posts. In other embodiments, the wire coil 305 and/or 310 may be formed around the pole posts of a bobbin and then shaped such that its profile is similar to the non-linear path of the pole posts. In one embodiment, a pole post can be configured to be moveable, such that the distance between adjacent pole posts may be reduced. For example, tension applied to a pole post may be reduced, allowing the pole post to be moved. In another embodiment, a moveable pole post may configured to move in such that it is at least partially deformed, allowing the wire coil to be shaped. A movable pole post may include at least one of a different material and shape from a non-movable pole post.

Location of Signal Processor

Figure 4:
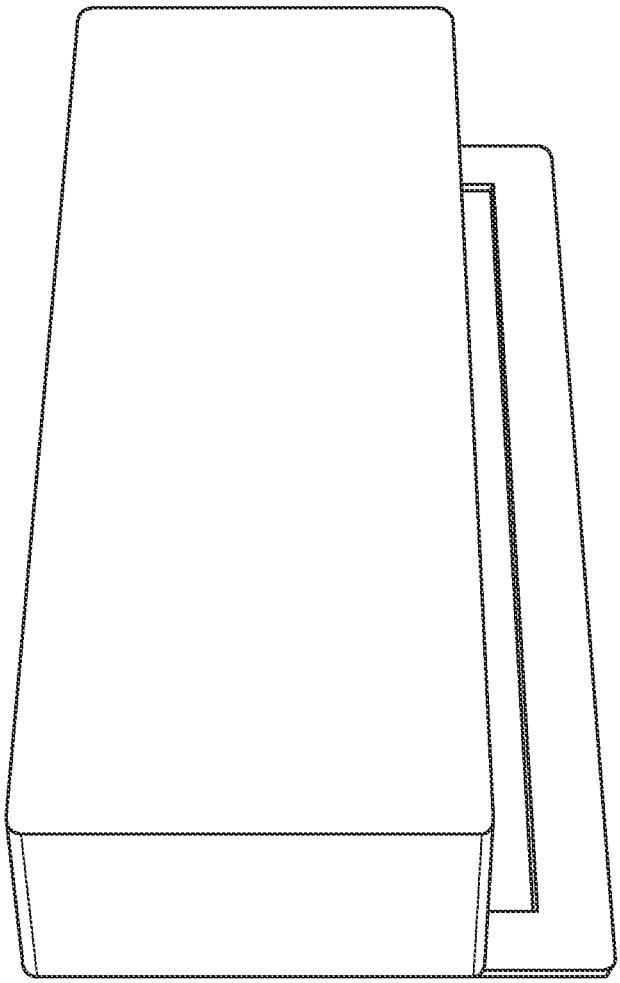
FIG. 4 depicts an encasing for tone-altering circuitry for a pickup according to an embodiment of the claimed invention.

The physical location of the signal processor can vary with respect to other components of the pickup, and in some cases with respect to other components of a corresponding string instrument. For example, a humbucker pickup can typically be coupled to a mounting plate on a stringed instrument (e.g., an electric guitar). The signal processor and other tone-altering circuitry can in some cases be placed under the mounting plate (e.g., between the mounting plate and a surface of the stringed instrument). For example, FIG. 4 depicts an encasing for tone-altering circuitry for a pickup according to an embodiment of the claimed invention. The encasing can house the signal processor and other tone-altering circuitry underneath the mounting plate of a pickup. The encasing can allow for electrical leads to pass to and from the tone-altering circuitry, and can be coupled to either the mounting plate (e.g., via a set of mounting screws) or the surface of the stringed instrument.

In some cases, the tone-altering circuitry can be located between the individual bobbins of the pickup (e.g., encased with the bobbins). In some cases, the tone-altering circuitry can be located at other locations of the stringed instrument, for example in another housing and the like. Regardless of the physical location on the stringed instrument or pickup housing, the tone-altering circuitry remains electrically between the first and second bobbins of the pickup, such that the tone-altering properties of the circuitry remain substantially similar regardless of the physical location of the circuitry on the stringed instrument or in the pickup housing.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A passive pickup for a string instrument, the pickup comprising:

a first coil wound around a first plurality of pole pieces, wherein a first end of the first coil is coupled directly to an output for coupling to an amplifier;

a second coil wound around a second plurality of pole pieces; and a passive tone-altering signal processor coupled to an end of the second coil and the output for coupling to an amplifier, in parallel with first end of the first coil.

2. The passive pickup of claim 1, wherein the passive tone-altering signal processor further comprises at least one inductor.

3. The passive pickup of claim 2, wherein the passive tone- altering signal processor further comprises at least one capacitor.

4. The passive pickup of claim 3, wherein the at least one capacitor and the at least one inductor are coupled in series or parallel.

5. The passive pickup of claim 2, further comprising an encasing, wherein the encasing encloses a first bobbin, a second bobbin, and the at least one inductor.

6. The passive pickup of claim 1, wherein the first coil and the second coil are wound in a counterclockwise direction or a clockwise direction.

7. The passive pickup of claim 1, wherein the first coil is wound in a clockwise direction and the second coil is wound in a counterclockwise direction.

8. The passive pickup of claim 1, wherein the first plurality of pole pieces and the second plurality of pole pieces each comprises at least four pole pieces.

9. The passive pickup of claim 1, wherein the first plurality of pole pieces and the second plurality of pole pieces each comprises at least six pole pieces.

10. The passive pickup of claim 1, wherein each of the first plurality of pole pieces and the second plurality of pole pieces are magnets.

11. The passive pickup of claim 1, wherein each of the first plurality of pole pieces and the second plurality of pole pieces comprises ferromagnetic materials lying within a magnetic field.

12. A string instrument comprising:

the passive pickup of claim 1; and a plurality of strings, wherein each string of the plurality of strings passes over a respective pole piece of the first plurality of pole pieces and the second plurality of pole pieces.

13. The string instrument of claim 12, wherein the string instrument is one of an electric guitar, an electric bass guitar, and an electric banjo.

14. A pickup for a string instrument, the pickup consisting of:

a first coil wound around a first plurality of pole pieces, wherein a first end of the first coil is coupled directly to an output for coupling to an amplifier;

a second coil wound around a second plurality of pole pieces; and a tone-altering signal processor coupled to an end of the second coil and the output for coupling to an amplifier.

* * * * *